United States Patent [19]

MacKay, Jr.

[11] Patent Number: 4,934,107

[45] Date of Patent: Jun. 19, 1990

[54] FINISHING ARTICLE HAVING AN INTEGRAL MOUNTING HUB AND IMPROVED COMPOSITE PRESSURE CAP

[76] Inventor: Joseph H. MacKay, Jr., 17551 Cabela Dr., San Diego, Calif. 92127

[21] Appl. No.: 327,853

[22] Filed: Mar. 22, 1989

Related U.S. Application Data

[63] Continuation-in-part of Ser. No. 298,375, Jan. 18, 1989, Pat. No. 4,899,494, which is a continuation-in-part of Ser. No. 212,448, Jun. 28, 1988, which is a continuation-in-part of Ser. No. 181,773, Apr. 15, 1988, Pat. No. 4,896,463, which is a continuation-in-part of Ser. No. 133,937, Oct. 27, 1987, Pat. No. 4,754,577, which is a continuation-in-part of Ser. No. 5,813, Jan. 21, 1987, Pat. No. 4,754,578, which is a continuation-in-part of Ser. No. 847,793, Apr. 3, 1986, Pat. No. 4,694,615.

[51] Int. Cl.[5] ..... B24B 45/00

[52] U.S. Cl. ..... 51/168; 51/209 R; 51/378; 15/230.18

[58] Field of Search ..... 51/168, 209 R, 358, 51/376, 377, 378, 389; 15/230.18, 230.19

[56] References Cited

U.S. PATENT DOCUMENTS

| | | | |
|---|---|---|---|
| 533,958 | 2/1895 | King | 51/168 X |
| 3,136,100 | 6/1964 | Robertson . | |
| 3,596,415 | 8/1971 | Donahue | 51/378 |
| 3,879,178 | 4/1975 | Bosma | 51/168 |
| 3,912,411 | 10/1975 | Moffat . | |
| 4,439,953 | 4/1984 | Block et al. | 51/389 |
| 4,449,329 | 5/1984 | Sauerwein et al. | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable finishing article for mounting on a rotatable threaded spindle which may be used with a power tool. The finishing article contains a retaining nut on one side and a backing flange on the other non-removably secured together on the finishing article without the aid of adhesives in such a manner that the finishing article is placed in compression when it is operably secured upon the spindle of the power tool under operational loads. The nut and flange are secured together by upsetting one end of the nut causing it to protrude outwardly over the outer surface of the flange. A metallic inverted cup shaped member and a molded plastic bearing are secured together to form a composite pressure cap and are maintained in operative relationship upon the outer surface of the backing flange. The cup is relatively rotatable with respect to the bearing to effect easy removal of the finishing article from the power tool. The backing flange includes radially extending fingers which secure the plastic bearing to the backing flange.

9 Claims, 3 Drawing Sheets

FINISHING ARTICLE HAVING AN INTEGRAL MOUNTING HUB AND IMPROVED COMPOSITE PRESSURE CAP

FIELD OF THE INVENTION

This invention relates generally to finishing articles and more particularly to such articles with a mounting hub permanently affixed thereto with the combination adapted for attachment to an appropriate portable power tool.

RELATED APPLICATION

This application is a continuation-in-part of U.S. Pat. application Ser. No. 298,375, filed Jan. 18, 1989 for FINISHING ARTICLE HAVING AN INTEGRAL AND IMPROVED PRESSURE CAP now U.S. Pat. No. 4,899,494 which is a continuation-in-part of U.S. Pat. application Ser. No. 212,448 filed June 28, 1988 for FINISHING ARTICLE HAVING AN INTEGRAL MOUNTING HUB AND IMPROVED BASE and is also a continuation-in-part of U.S. Pat. application Ser. No. 181,773, filed Apr. 15, 1988 for DISPOSABLE FINISHING ARTICLE HAVING AN INTEGRAL MOUNTING HUB INCLUDING A PRESSURE CAP SECURED BY ROTATION now U.S. Pat. No. 4,896,463 which is a continuation-in-part of U.S. Pat. application Ser. No. 133,937, filed Oct. 27, 1987 for DISPOSABLE FINISHING ARTICLE HAVING AN INTEGRAL MOUNTING HUB INCLUDING AN IMPROVED PRESSURE CAP, now U.S. Pat. application Ser. No. 005,813 filed Jan 21, 1987 for DISPOSABLE DEPRESSED CENTER GRINDING WHEEL HAVING AN INTEGRAL MOUNTING HUB now U.S. Pat. No. 4,754,578 which is a continuation-in-part of U.S. Pat. application Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

BACKGROUND OF THE INVENTION

The use of rotatably driven finishing articles and particularly grinding wheels is widespread and familiar in our industrial society. One of the more serious problems encountered in the use of such devices resides in the provision of effective means for preventing undesired or accidental disassociation of the finishing article or grinding wheel from the shaft, spindle or other rotatable drive means on which it is mounted. This problem is particularly acute when the connection between the finishing article or grinding wheel and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly of parts has been used for large grinding wheels as well as small cut-off wheels. Such an assembly, however, typically requires appropriate tools such as wrenches or the like to remove the grinding wheel from the drive shaft. Such a device is shown in U.S. Pat. Nos. 489,149; 2,633,008; 2,990,661; 3,596,415; 1,998,919; 566,883; 507,223; 1,162,970; 791,159; 489,149 and 3,210,982.

Subsequently it became desirable to affix the mounting hub permanently to the finishing article or grinding wheel so that the entire unit may be quickly and easily attached and detached from the drive shaft and discarded when the finishing article or grinding wheel has been expended or worn down. In these types of devices it is customary to utilize an adhesive such as an epoxy resin or the like between the backing flange and the back surface of the finishing article or grinding wheel to retain integrity between the mounting hub and the finishing article or grinding wheel to secure the article or wheel rotationally.

Even though the adhesive tended to work quite well in most applications, it was discovered that in some instances the adhesive would break loose and the finishing article or grinding wheel would rotate relative to the mounting hub. Such was particularly the case since the hub was a one-piece member which was internally threaded and held in place by swaging an extension thereof, thus providing a fixed clamping force holding the finishing article or grinding wheel. No additional clamping force was exerted during further rotation of the article or wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,601,661; 791,791; 872,932; 2,567,782; 3,136,100, 3,210,892; 3,623,281; 4,449,329; and 3,621,621.

The devices utilized in the prior art for providing the disposable finishing article and grinding wheel assemblies including the permanently affixed mounting hub generally provide the service intended. There are, however, certain inherent disadvantages found with regard to the various devices. Such disadvantages are that in manufacturing the utilization of an adhesive adds additional materials and labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a spindle for rotation by a power tool. The drive member includes a backing flange on one side of the finishing article and a retaining nut positioned on the opposite side of the finishing article from the backing flange. The nut extends through an opening in the finishing article and has a radial flange at one end thereof seated against the face of the article and protrusion means extending from the other end thereof for non-removably securing the retaining nut and the backing member together on the finishing article without the use of adhesives. A composite pressure cap defining a central opening is held in place by a plurality of radially extending fingers on the outer surface of the backing flange to apply pressure to the flange during operation of the finishing article. More particularly, the composite pressure cap is a metallic inverted cup shaped member secured in a relatively rotatable manner to a molded plastic bearing which in turn is secured to the fingers on the backing flange outer surface.

The composite pressure cap extends longitudinally away from the backing flange to engage the power tool spindle seat for placing the finishing article in compression during use thereof when the finishing article is operatively secured upon the spindle of the power tool.

DETAILED DESCRIPTION

Figure 1:
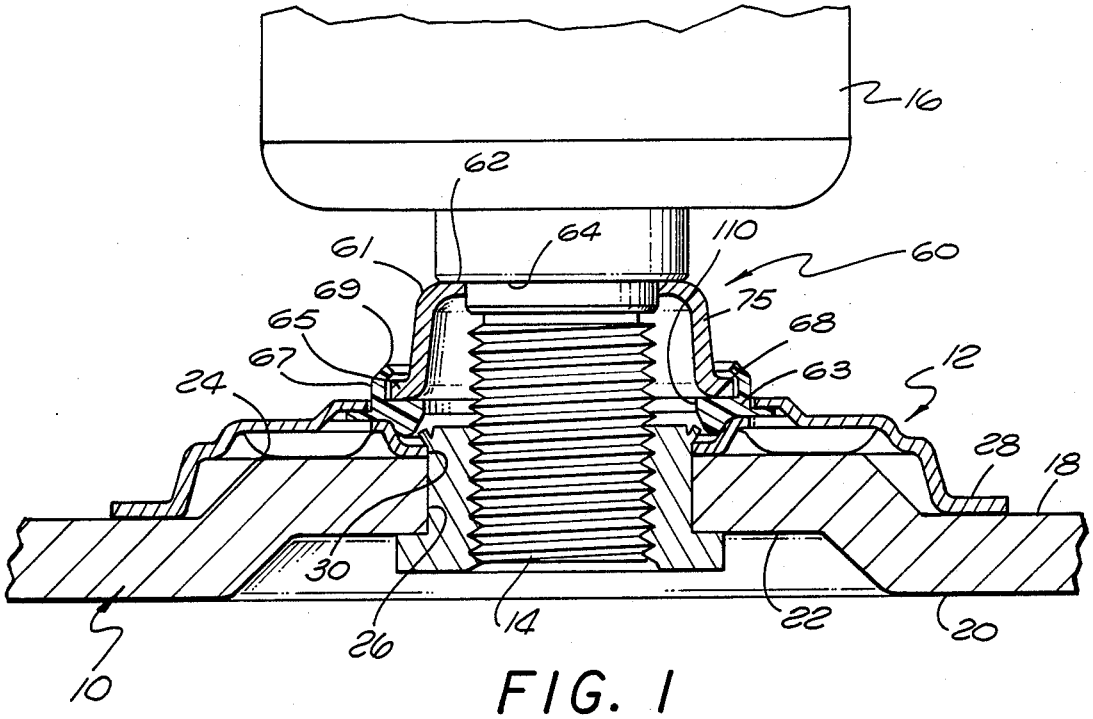
FIG. 1 a cross sectional view of a finishing article assembly constructed in accordance with the principles of the present invention and mounted in operable position on the spindle of a power tool.

By reference now to FIGS. 1 through 9, there is illustrated a preferred embodiment of a disposable finishing article drive member assembly constructed in accordance with the principles of the present invention. The finishing article constructed in accordance with the present invention may take many forms, such, for example, as grinding wheels, flap wheels, wire wheels, abrasive disks or pads, buffs or the like. For purposes of ease of illustration and clarity of description only a depressed center grinding wheel will be shown and described. It will, however, be understood by those skilled in the art that other disposable finishing articles which may be placed in compression during use thereof may be substituted for the grinding wheel without departing from the spirit or scope of the present invention.

As is shown in FIGS. 1 through 6, a depressed center grinding wheel 10 has a disposable drive member or hub assembly 12 permanently affixed thereto without the use of adhesives so that the grinding wheel may be attached to the threaded spindle 14 of an appropriate power tool 16 (only partially illustrated). According to the principles of the present invention, a disposable mounting hub or drive member is constructed in such a manner that when the grinding wheel is placed in operation upon the spindle 14, the grinding wheel 10 is placed in compression and the more force that is applied to the grinding wheel during utilization thereof, the greater the operational compression becomes. As a result of placing the grinding wheel in such compression the grinding wheel is maintained upon the spindle and at the same time, through the compression or clamping force, the grinding wheel 10 cannot rotate relative to the drive member or hub assembly 12. However, as a result of the construction of the drive member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized. However, when certain types of finishing articles are utilized such that the outer circumference or face is used instead of the entire face, then a depressed center may not be included in the article.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. Circular reinforcing ribs 32 and 34 are formed in the backing flange 28 concentrically with the opening 30. Radial reinforcing ribs 33 are formed intersecting the concentric ribs 32 and 34. It has been found that the use of the radial ribs 33 on the backing flange 28 provides unexpected stiffness. Such stiffness is desired in certain applications of grinding wheels where large amounts of pressure are applied to the wheel during grinding. The backing flange 28 is preferably stamped from sheet metal but of course could be constructed from other materials such as hard molded plastic or die cast metal should such be desired.

Figure 3:
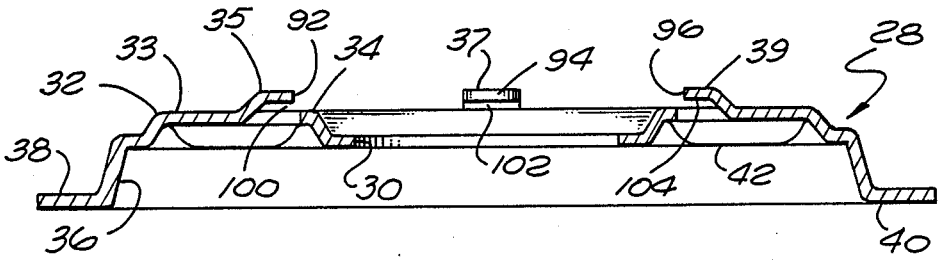
FIG. 3 is a cross sectional view taken about the lines 3—3 in FIG. 2 of a backing flange constructed in accordance with the present invention.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes a land 40. The land 40 is formed about the outer peripheral portion of the backing flange 28. The land 40 always engages the back surface 18 of the abrasive finishing wheel away from the depressed center. In addition, a broken land 42 is formed by the inner surface 36 between the radial reinforcing ribs 33. The land 42 may engage the back surface of the abrasive finishing wheel 10 opposed the depressed center 22 thereof depending upon variations in wheel dimensions and manufacturing tolerances in the wheels and flanges.

As can be seen, particularly in FIG. 3, the ribs 32 and 34 formed in the outer surface 38 of the backing flange 22 are continuous. The continuous rib 32 is disposed between the lands 40 and 42 and over the transitional area between the depressed center and the remainder of the grinding wheel 10 while the continuous rib 34 is disposed intermediate the opening 30 and the land 42. Selected ones of the radial reinforcing ribs 33 have radially inwardly directed fingers 35, 37, 39 and 41 formed therein. Preferably, when the backing flange 28 is fabricated from stamped sheet metal the fingers 35, 37, 39 and 41 may be formed by cutting or punching the sheet metal during the stamping operation. When the fingers are formed a space is provided beneath the distal end 92, 94, 96 and 98 as shown at 100, 102, 104 and 106 respectively. The purpose and function of the gripping fingers will be described hereinafter.

Figure 4:
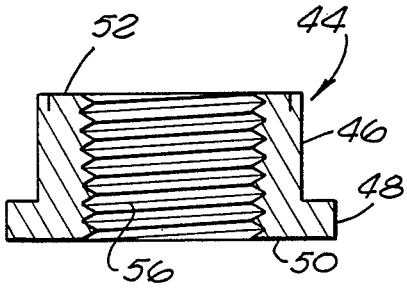
FIG. 4 is a cross sectional view of a retaining nut constructed in accordance with the principles of the present invention.

As shown in FIG. 4, a retainer nut 44 includes a body portion 46 which is hollow and has a radially outwardly extending flange 48 at a first end 50 thereof. The internal surface of the body 46 has threads 56 formed therealong for attachment to the threaded spindle 14 of the power tool. The nut 44 is inserted through the aperture 26 in the grinding wheel and the aperture 30 in the flange 28 from the front surface 20 toward the rear surface 18 of the grinding wheel 10. The end 52 of the nut 44 extends through the opening 30 in the flange 28.

The nut 44 is preferably constructed as a metal die casting is then machined to provide the threads 56. Alternatively the nut may be formed from aluminum or steel bar stock or an aluminum extrusion or molded plastic which is then machined as appropriate.

Figure 5:
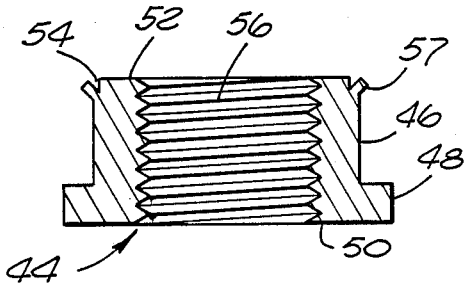
FIG. 5 is a cross sectional view of the retaining nut of FIG. 5 after being upset.
Figure 2:
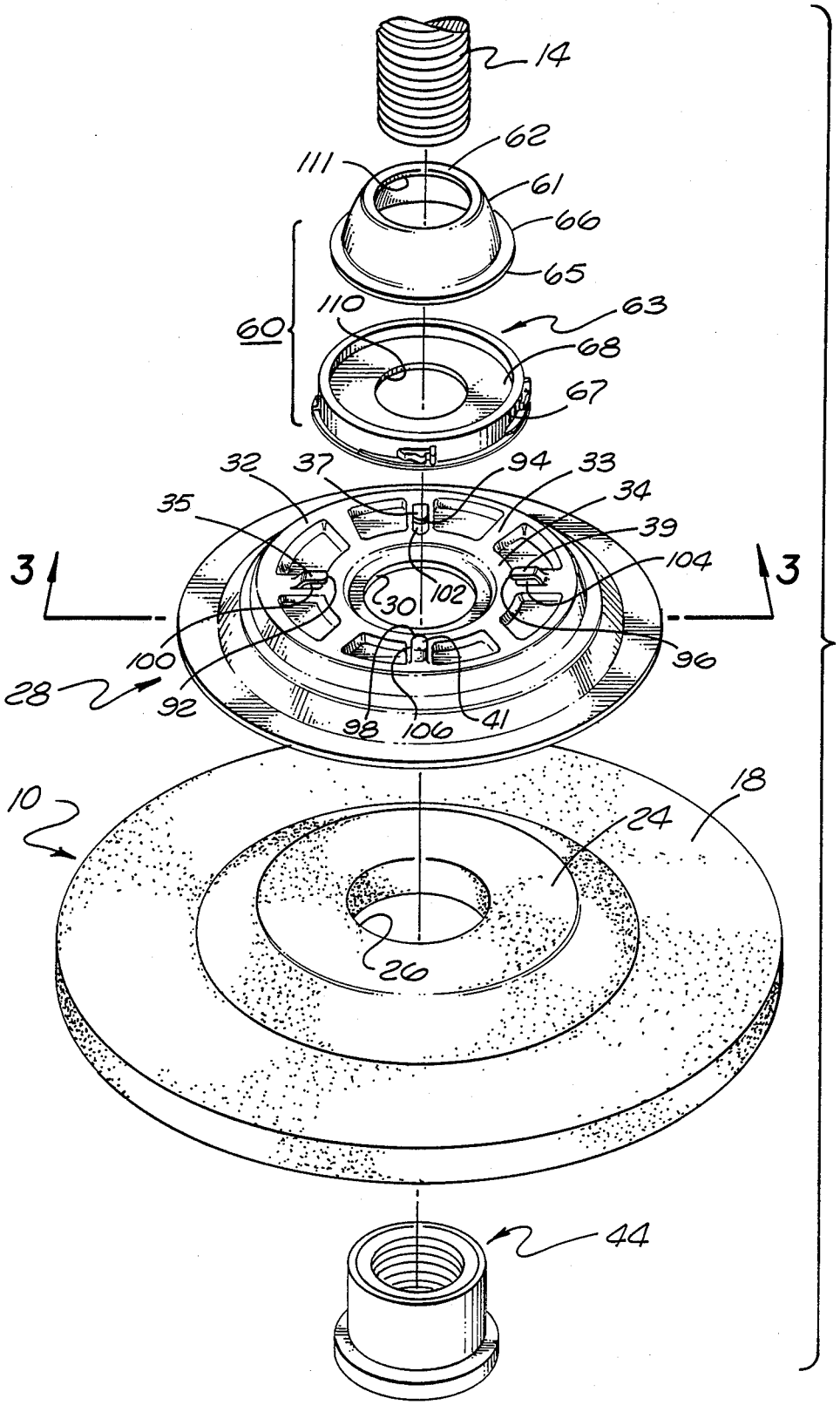
FIG. 2 is an exploded view of the structure as illustrated in FIG. 1.
Figure 6:
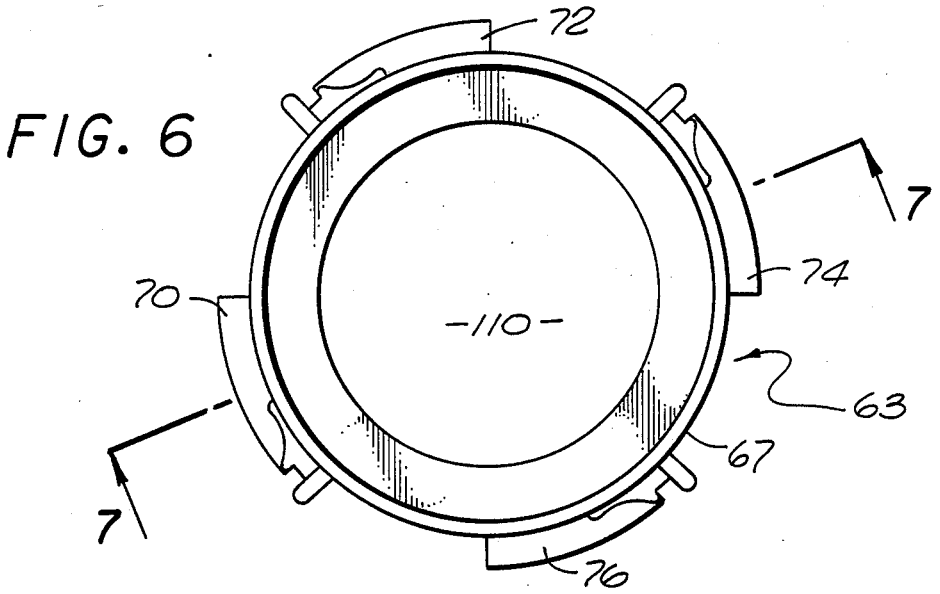
FIG. 6 is a top plan view of a composite pressure cap constructed in accordance with the present invention.
Figure 7:
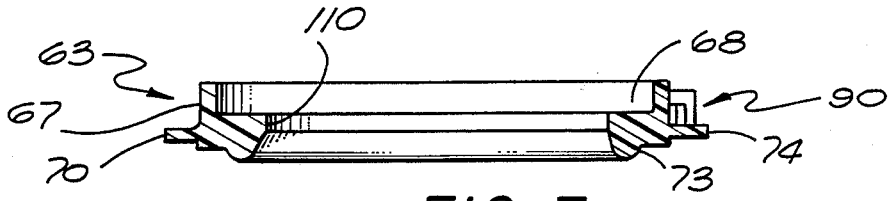
FIG. 7 is a cross sectional view taken about the line 7—7 of FIG. 6 showing construction of the bearing element of the composite pressure cap.

Once the nut 44 has been inserted through the openings in the wheel 10 and the flange 28, the end 52 thereof is upset such as by a staking operation to provide a protrusion 56 extending outwardly therefrom as shown specifically in FIG. 5. The protrusion may be formed as a series of separate protrusions, or, as shown, as a continuous protrusion. Preferably the protrusion is formed by a staking operation which forms a continuous groove 54 in the end of 52 the nut 44. Formation of the groove 54 causes the displaced material to form a lip or overhang 57 which will overlie the back of the backing flange 28 about the opening 30 therethrough. It should become apparent to those skilled in the art that the flange 28 and the nut 44 are secured together on the wheel 1 between the flange 48 and the overhang 57 without the use of adhesives.

To provide proper operational compressive forces of the throwaway grinding wheel as above-described, a composite pressure cap 60 is rotated into locking engagement with the hub assembly 12. The composite pressure cap 60 includes an inverted metallic cup shaped member 61 having a first or rear surface 62 for engaging a surface 64 on the power tool spindle when the grinding wheel is in an operable position on the power tool 16. The cup 61 is relatively rotably secured to a molded plastic bearing 63 to complete the composite pressure cap 60. The plastic bearing 63 may be constructed from such plastic material as polypropylene, acetal, nylon or the like. The top surface 68 of the bearing 63 is a flat surface which receives a radially outwardly extending flange 65 formed on the base 66 of the cup 61. A wall 67 extending upwardly from the surface 68 of the bearing 63 encircles the flange 65 and is deformed inwardly as shown at 69 by heat and pressure to capture the flange 65 and secure the cup 61 to the bearing 63. The wall 67 is preferably continuous as shown in solid lines but alternatively may be discontinuous as shown in dashed lines 91 in FIG. 8. When a discontinuous wall is used it forms a plurality of upstanding fingers and each may be formed with a cam like inner or outer surface and a locking detent so that the cup 61 may be snapped into place and secured. Obviously if the cam surface is on the outer portion, the flange 65 would be radially inwardly directed to grip the fingers when snapped into place. It should be noted that when the grinding wheel is operatively secured to the spindle of the power tool 16 that the cup 61 and bearing 63 may rotate relative to each other. Such rotation along with the use of dissimilar materials for the cup and bearing prevent galling or binding and effects easy removal of the grinding wheel from the power tool without the use of tools or excessive forces. The composite pressure cap 60 is retained in position on the hub assembly 12 by a plurality of radially outwardly extending tangs 70, 76, 72 and 74. These tangs extend outwardly from the wall 67 on the bearing 63. A front surface 73 on the bearing 63 contacts the top of the continuous rib 34.

Figure 8:
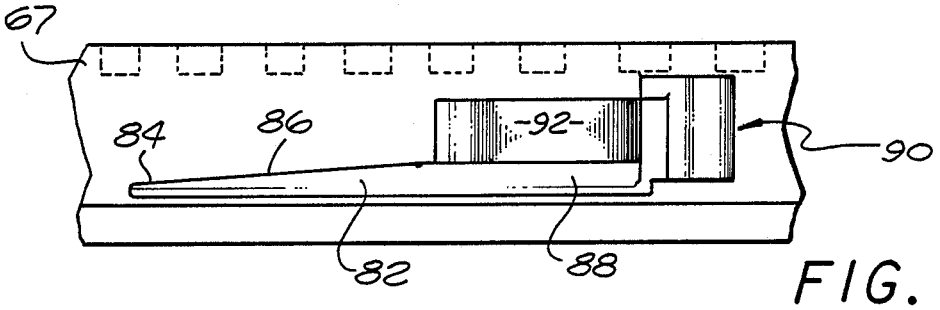
FIG. 8 s a fragmentary elevational view showing the construction of a tang in greater detail.
Figure 9:
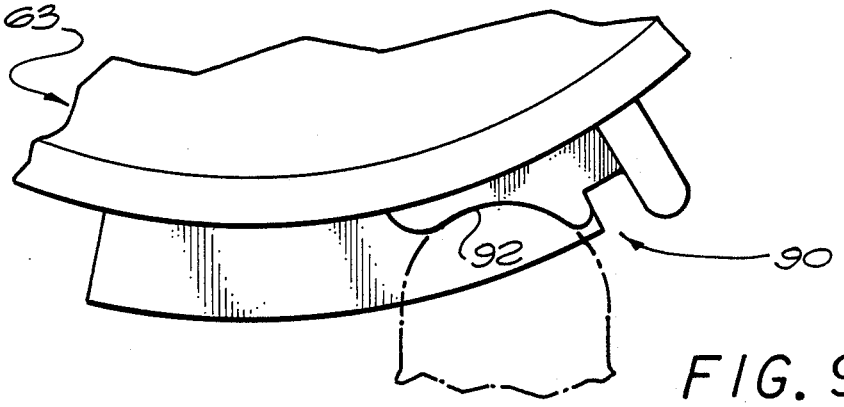
FIG. 9 is a fragmentary top plan view showing the cooperative relationship between a finger and a locking detent on the composite pressure cap.

As is more easily seen in FIG. 8, each of the tangs 70 through 76 includes a wedge shaped portion 82 with the thinner section 84 thereof at the leading edge. A surface 86 defines an inclined plane or ramp which is used in securing the composite pressure cap 60 on the flange 28. Adjacent the thickest portion 88 of the wedge shaped portion 82 is a stop member 90. The stop member 90 defines a detent 92.

Once the flange 28 and the retaining nut 44 are secured upon the wheel 10 the composite pressure cap 60 is secured thereon in the following manner: Tangs 70 through 76 are positioned between the fingers 35 through 41 with the surface 73 engaging the rib 34. The composite pressure cap 60 is then rotated clockwise so that the leading edge 84 of the tangs enters the spaces 100 through 106. Rotation is continued to effect an interference fit between the ramp 86 and the finger associated therewith. Finally, the distal end 92 through 98 of the fingers will be positioned within the detent 92 of its respective stop member as more specifically shown in FIG. 9. It will be noted particularly in FIG. 1 that the reinforcing rib 34 has a predetermined radius of curvature and that the surface 73 of the plastic bearing has a complimentary radius of curvature. Thus, when the cup and bearing are secured together and the wheel secured on the power tool, forces are easily transmitted through the wall 75 of the cup 61 and the body 77 of the bearing 63 to the flange 28.

From the drawings, it is noted that there are an equal number of fingers and tangs and that they are equiangularly spaced. Although such an arrangement will usually be preferred, it must be understood that it is not necessary. For example, there may be a greater or lesser number of tangs and fingers and they need not be equiangularly disposed. It should be recognized that the sole function of the tangs and fingers is to secure the composite pressure cap to the flange. Once secured, the tangs and fingers do not transmit or carry loads of any kind.

The body 77 of the bearing 63 defines an aperture 110 while the cup 61 defines an aperture Ill each for receiving the spindle 14 of the power tool. When assembled on the backing flange 28 the apertures 26, 30, 110 and 111 are aligned axially. As will be noted, when the grinding wheel is in use on the power tool compressive forces are transmitted through the wall 75 and body 77 of the composite pressure cap 60 between the surfaces 62 and 73. The wall 75 and the body 77 between surfaces 62 and 73 are essentially a straight line and therefore easily carry these forces. The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the spindle seat 64. The interengagement between the threads 14 and 56 of the spindle and nut, respectively, urge the nut upward toward the flange 28 as the wheel is seated upon the spindle. At the same time, the spindle seat 64 applies a downward force to surface 62 of the composite pressure cap 60 which in turn, through the surface 73 applies a downward force to the flange 28. Therefore, this mutual clamping force causes the grinding wheel to be placed in compression. Those skilled in the art will recognize that as the grinding wheel 10 is used by being placed against a workpiece, additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. However, through the use of the plastic bearing 63 the wheel easily releases from the power tool with hand force only when rotated in the opposite direction. It will be recognized by those skilled in the art that the grinding wheel assembly as illustrated in FIGS. 1 through 9 and as above described require no adhesive for construction and may be simply and easily assembled, is relatively light in weight as compared to the prior art devices utilizing the cast hubs and provides a secure attachment of the finishing article to the power tool and through the utilization of the increased compression precludes relative rotation of the finishing article with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Through the structure as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable finishing article driving member assembly which securely holds the article during operation, which is light in weight, vibration-free, and less expensive than prior art throw-away articles while meeting all safety standards currently known and in existence.

What is claimed is:

1. A finishing article device having a disposable drive member non-removably affixed thereto for mounting on a threaded rotatable spindle of a power tool comprising:

a finishing article having a face and a back and having a first centrally disposed aperture therethrough;

a backing flange having an inner and outer surface and diameter smaller than the diameter of said finishing article and defining a second centrally disposed aperture therethrough, and a plurality of fingers extending radially from said outer surface thereof and defining space therebeneath, said first and second apertures aligned;

a retaining nut having a hollow internally threaded body having first and second ends and a first radially outwardly extending flange extending from said first end of said body, said body extending through said first and second apertures with said radial flange seated against said face;

means protruding outwardly from said second end of said body to non-removably secure said retaining nut and said backing flange together on said wheel without the use of adhesives; and composite pressure cap means defining a centrally disposed opening therethrough secured to said fingers extending radially from said backing flange to apply force to said backing flange when said finishing article is secured on said spindle to cause said backing flange and said retaining nut to move toward each other to compress said finishing article therebetween as operative loads are applied to said article during use on said power tool, said composite pressure cap including a molded plastic bearing having a securing means extending therefrom for engaging said fingers for securing said cap to said backing flange, and an inverted metallic cup shaped member secured to said plastic bearing.

2. A finishing device as defined in claim 1 wherein said cup includes a first surface for engaging said spindle and said plastic bearing includes a second surface for engaging said backing flange when said composite pressure cap is secured to said finishing device.

3. A finishing device as defined in claim 2 wherein said backing flange outer surface defines a reinforcing rib having a predetermined radius of curvature, said second surface of said plastic bearing having a radius of curvature substantially complimentary to that of said rib.

4. A finishing device as defined in claim 1 wherein said plastic bearing includes a third surface, said cup shaped member being retained on said surface.

5. A finishing device as defined in claim 4 wherein said cup shaped member includes a base terminating in an outwardly extending flange, said flange being received within said third surface, and said plastic bearing further includes means extending from said third surface to engage said flange and secure said cup to said bearing.

6. A finishing device as defined in claim 5 wherein said means extending from said third surface is a wall having an upper portion thereof deformed inwardly.

7. A finishing device as defined in claim 6 wherein said wall is discontinuous.

8. A finishing device as defined in claim 6 wherein said wall is continuous.

9. A finishing device as defined in claim 1 wherein said fingers extend radially inwardly and said plastic bearing securing means includes a plurality of outwardly extending tangs, each of said tangs having a wedge shaped portion adapted to be received under one of said fingers.

* * * * *